US009111512B2

(12) United States Patent
Richards

(10) Patent No.: US 9,111,512 B2
(45) Date of Patent: Aug. 18, 2015

(54) DRUMSTICK GRIP

(71) Applicant: Kirt Ashley Richards, Newbury Park, CA (US)

(72) Inventor: Kirt Ashley Richards, Newbury Park, CA (US)

( * ) Notice: Subject to any disclaimer, the term of this patent is extended or adjusted under 35 U.S.C. 154(b) by 0 days.

(21) Appl. No.: 13/890,779

(22) Filed: May 9, 2013

(65) Prior Publication Data

US 2013/0298749 A1 Nov. 14, 2013

Related U.S. Application Data

(60) Provisional application No. 61/646,838, filed on May 14, 2012.

(51) Int. Cl.
*G10D 13/02* (2006.01)
*G10D 13/00* (2006.01)

(52) U.S. Cl.
CPC ..... *G10D 13/003* (2013.01)

(58) Field of Classification Search
CPC ..... G10D 13/003
USPC ..... 84/422.4
See application file for complete search history.

(56) References Cited

U.S. PATENT DOCUMENTS

| | | | | | |
|---|---|---|---|---|---|
| 1,980,655 | A | * | 11/1934 | Balistreri | 15/143.1 |
| 2,666,340 | A | * | 1/1954 | Hunt | 74/551.9 |
| 3,608,419 | A | * | 9/1971 | Russell | 84/422.4 |
| D222,213 | S | * | 10/1971 | Rumaner | D8/303 |
| 4,934,024 | A | * | 6/1990 | Sexton, I | 16/421 |
| 5,261,665 | A | * | 11/1993 | Downey | 473/303 |
| 5,267,487 | A | * | 12/1993 | Falco et al. | 74/558 |
| 5,361,671 | A | * | 11/1994 | Genna | 84/422.4 |
| 5,447,088 | A | * | 9/1995 | Mester | 84/422.4 |
| 5,581,031 | A | * | 12/1996 | Blankenship, Jr. | 84/453 |
| 5,692,265 | A | * | 12/1997 | Dalury | 16/430 |
| 5,696,339 | A | * | 12/1997 | Brennan | 84/422.4 |
| 6,028,261 | A | * | 2/2000 | Johnson | 84/422.4 |
| 6,310,278 | B1 | * | 10/2001 | Butler | 84/422.4 |
| 6,423,890 | B2 | * | 7/2002 | Zbrzezny et al. | 84/422.4 |
| 6,817,956 | B1 | * | 11/2004 | Dagenais | 473/300 |
| 6,872,157 | B2 | * | 3/2005 | Falone et al. | 473/568 |
| 6,889,405 | B2 | * | 5/2005 | Ritrovato et al. | 16/430 |
| 6,904,615 | B2 | * | 6/2005 | Kobe et al. | 2/161.8 |
| D531,875 | S | * | 11/2006 | Chen | D8/80 |
| 7,334,298 | B2 | * | 2/2008 | Willat et al. | 16/435 |
| D573,351 | S | * | 7/2008 | Angers et al. | D4/138 |
| 7,687,700 | B1 | * | 3/2010 | Torres | 84/422.4 |
| 7,828,680 | B2 | * | 11/2010 | Pfeifer | 473/513 |
| 7,946,937 | B2 | * | 5/2011 | Searle | 473/521 |
| 8,389,842 | B2 | * | 3/2013 | Alleyne | 84/422.4 |
| 8,506,418 | B2 | * | 8/2013 | Tremulis et al. | 473/300 |
| 8,987,569 | B2 | * | 3/2015 | Huber | 84/422.4 |
| 2004/0025666 | A1 | * | 2/2004 | Mizuno et al. | 84/422.4 |
| 2013/0298749 | A1 | * | 11/2013 | Richards | 84/422.4 |

* cited by examiner

*Primary Examiner* — Robert W Horn
(74) *Attorney, Agent, or Firm* — Jonathan L. Pettit

(57) ABSTRACT

According to one aspect, a grip for drumsticks is provided. The grip comprise a substantially cylindrical sleeve that slips onto a drumstick comprising a tip end and a handle end. The sleeve comprises a first opening and a second opening on opposite ends of the sleeve and is capable of slipping onto either the tip end or the handle end of the drumstick via either the first opening or the second opening of the sleeve. In an embodiment, the sleeve comprises a flexible material such as polyurethane foam material or a nitrile rubber material.

6 Claims, 6 Drawing Sheets

DRUMSTICK GRIP

RELATED APPLICATION

This application claims priority to the following provisional application and is hereby incorporated by reference in its entirety: U.S. Provisional Patent Application Ser. No. 61/646,838, titled DRUMSTICK AND GOLF CLUB GRIP, filed May 14, 2012.

BACKGROUND

1. Field of the Invention

The present invention relates generally to grips and, more particularly, to grips for drumsticks.

2. Related Art

Drummers use drumsticks to strike the drum to create a desired sound. However, repeating this striking motion many times over a period of time can lead to side effects for the drummer such as hand fatigue, muscle cramping and joint pain. In addition, after playing in sessions on the drums, sweat can become a problem making it more difficult for the drummer to grip the drumsticks. Also, some drummers, such as those with large hands, often have problems gripping the drumsticks during normal usage.

SUMMARY

According to one aspect, a grip for drumsticks is provided. The grip comprise a substantially cylindrical sleeve that slips onto a drumstick comprising a tip end and a handle end. In an embodiment, the sleeve comprises a first opening and a second opening on opposite ends of the sleeve and is capable of slipping onto either the tip end or the handle end of the drumstick via either the first opening or the second opening of the sleeve. In an embodiment, the sleeve comprises a flexible material such as a polyurethane foam material or a nitrile rubber material. In an embodiment, the sleeve comprises an inner cylindrical wall and an outer cylindrical wall, wherein the distance between the inner cylindrical wall and the outer cylindrical wall is approximately 0.20 inches to 0.25 inches. In an embodiment, the longitudinal length of the sleeve is approximately 5.25 inches to 6.5 inches, the diameter of the inner cylindrical wall is approximately 0.425 inches, and the circumference of the outer cylindrical wall is approximately 0.875 inches to 3.0 inches.

According to another aspect, a grip for drumsticks is provided comprising a substantially cylindrical sleeve that slips onto a drumstick comprising a tip end and a handle end, and where the sleeve comprises a proximal end and a distal end on opposite ends of the sleeve. In an embodiment, the proximal end of the sleeve comprises an opening and the distal end of the sleeve comprises a cap, where the proximal end of the sleeve is designed to slip onto a handle end of the drumstick. In an embodiment, the sleeve comprises a flexible material such as a polyurethane foam material or a nitrile rubber material. In an embodiment, the sleeve comprises an inner cylindrical wall and in outer cylindrical wall, wherein the distance between the inner cylindrical wall and the outer cylindrical wall is approximately 0.20 inches to 0.25 inches. In an embodiment, the longitudinal length of the sleeve is approximately 5.25 inches to 6.5 inches, the diameter of the inner cylindrical wall is approximately 0.425 inches and the circumference of the outer cylindrical wall is approximately 0.875 inches to 3.0 inches. In an embodiment, the cap comprises an inner wall and an outer wall that are substantially hemispherical in shape.

According to another aspect, a grip for drumsticks is provided comprising a flexible, tubular sleeve that slips onto a drumstick comprising a tip end and a handle end. In an embodiment, the sleeve comprises a first opening and a second opening on opposite ends of the sleeve and is capable of slipping onto either the tip end or the handle end of the drumstick via either the first opening or the second opening of the sleeve. In an embodiment, the sleeve comprises a closed-cell polyurethane foam material. In an embodiment, the sleeve comprises an inner cylindrical wall and an outer cylindrical wall, wherein the distance between the inner cylindrical wall and the outer cylindrical wall is approximately 0.20 inches to 0.25 inches. In an embodiment, the longitudinal length of the sleeve is approximately 5.25 inches to 6.5 inches, the diameter of the inner cylindrical wall is approximately 0.425 inches and the circumference of the outer cylindrical wall is approximately 0.875 inches to 3.0 inches.

BRIEF DESCRIPTION OF THE DRAWINGS

The details of the present invention, both as to its structure and operation, may be gleaned in part by study of the accompanying drawings, in which like reference numerals refer to like parts, and in which.

DETAILED DESCRIPTION

Certain embodiments as disclosed herein provide for a drumstick grip that improves grip friction for the drummer, relieves hand cramps and pain, installs easily, and is washable and reusable. After reading this description it will become apparent to one skilled in the art how to implement the invention in various alternative embodiments and alternative applications. However, although various embodiments of the present invention will be described herein, it is understood that these embodiments are presented by way of example only, and not limitation.

Figure 1:
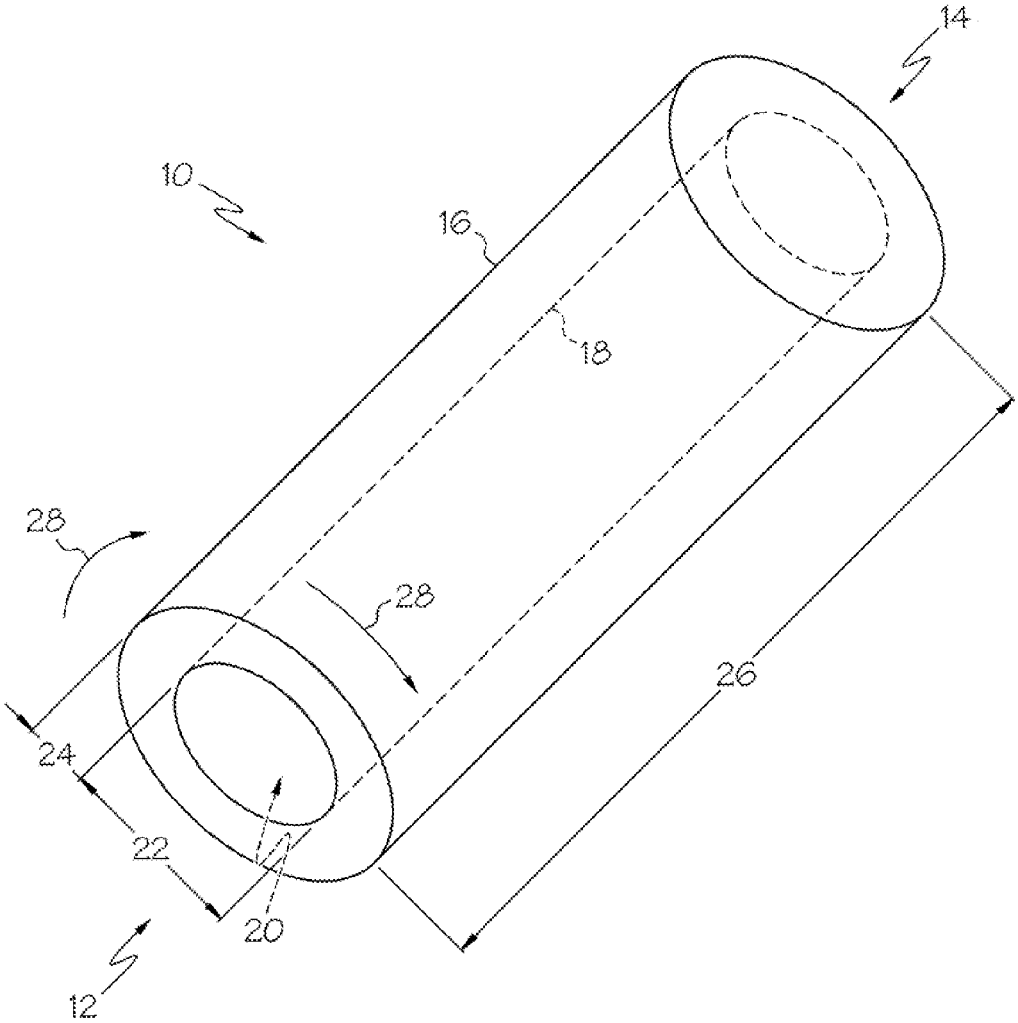
FIG. 1 is a perspective view of a drumstick grip according to a first embodiment.
Figure 2:
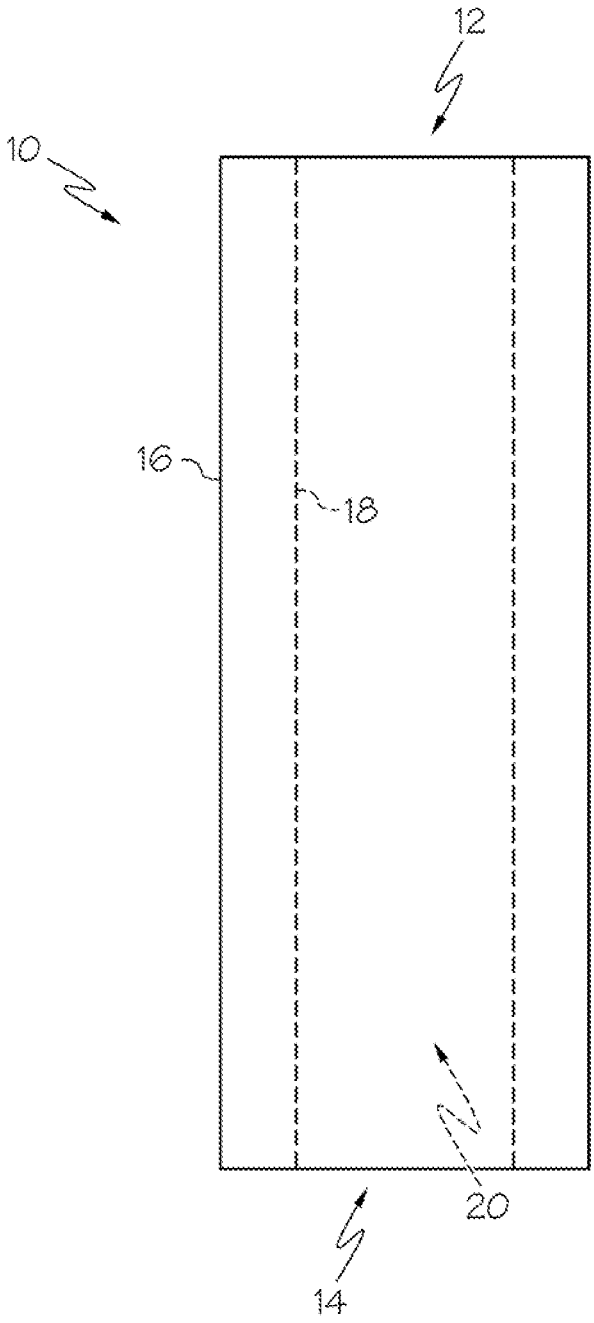
FIG. 2 is a side plan view of the drumstick grip of FIG. 1.

FIGS. 1 and 2 illustrate a drumstick grip 10 in a first embodiment. As illustrated in FIGS. 1 and 2, the grip 10 is generally cylindrical in shape, with a cylindrical internal passageway 20 comprising the longitudinal length of the grip 10. The grip 10 comprises a first end 12 and a second end 14 that are similar in form in this embodiment. In this embodiment of grip 10, the cylindrical internal passageway 20 is designed to receive a drumstick through either the first end 12 or the second end 14. The grip 10 comprises an outer cylindrical wall 16 and an inner cylindrical wall 18. A width 22 is the diameter of the cylindrical internal passageway 20 within the inner cylindrical wall 18. A width 24 of the grip 10 is the distance between the outer cylindrical wall 16 and the inner cylindrical wall 18. The grip 10 comprises a longitudinal length 26 which is the distance from the first end 12 to the second end 14. Furthermore, a circumference 28 is the length of the circumference of the outer cylindrical wall 16 of the grip 10.

In one example of the grip 10, the width 22 of the diameter of the cylindrical internal passageway 20 within the inner cylindrical wall 18 is approximately 0.425 inches, while the width 24 of the grip 10 between the outer cylindrical wall 16 and the inner cylindrical wall 18 is approximately 0.20 to 0.25 inches. Further, in another example, the longitudinal length 26 of the distance from the first end 12 to the second end 14 is approximately 5.25 to 6.50 inches. In addition, the circumference 28 of the outer cylindrical wall 16 of the grip 10 is approximate 2⅞ to 3 inches. The above dimensions are examples, and it is recognized that these dimensions can be modified depending upon such factors as hand sizing and personal preference of a user.

In one embodiment, the grip 10 is formed from a closed-cell polyurethane foam material. In an embodiment, this closed-cell polyurethane foam material comprises nitrile rubber. This type of material allows the grip 10 to provide non-slip gripping qualities for the drummer. In addition, the material is flexible, washable and easy to install.

Figure 3:
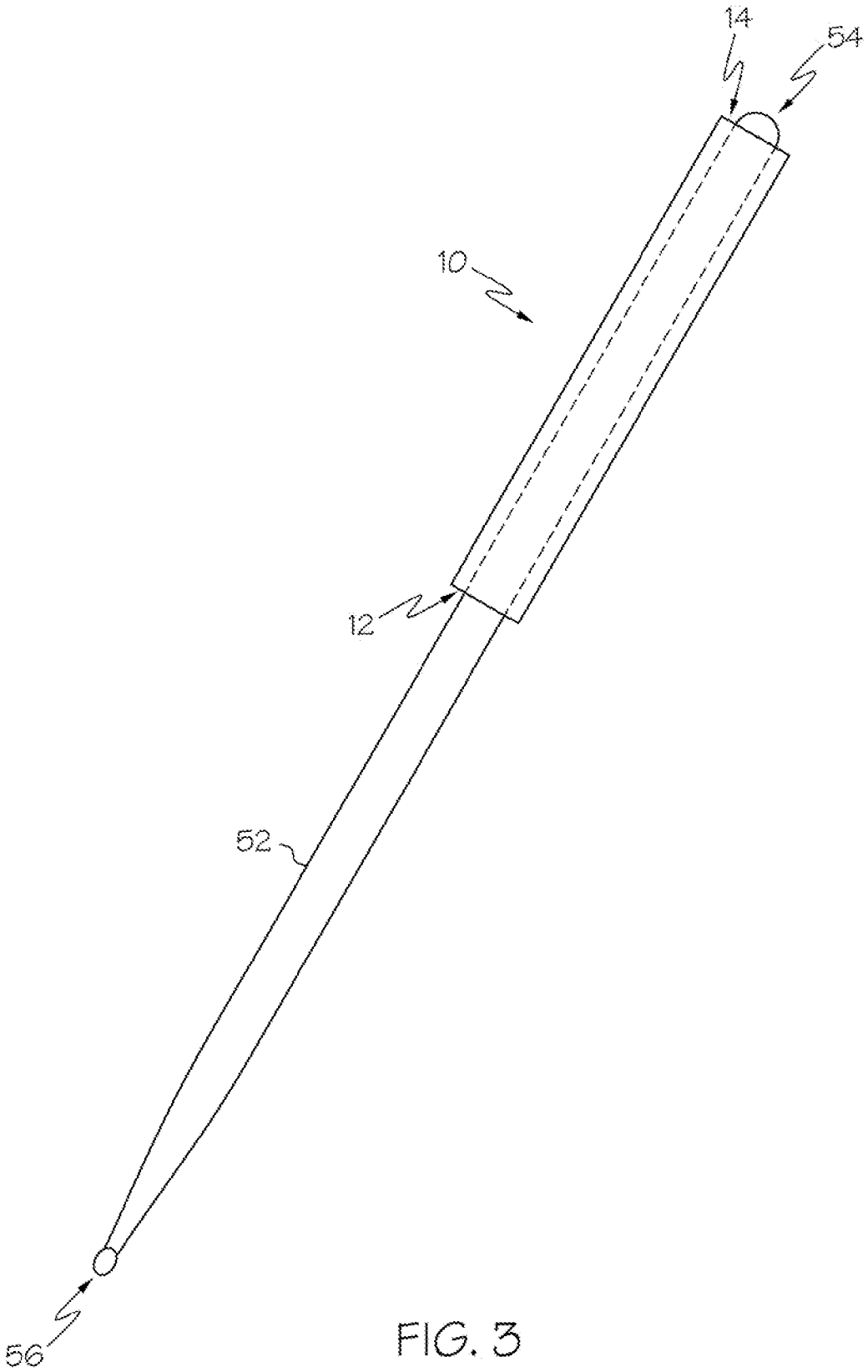
FIG. 3 is a side plan view of the drumstick grip of FIG. 1 attached to a standard drumstick.

FIG. 3 illustrates the grip 10 of FIGS. 1 and 2 as installed on a standard drumstick 52 according to one embodiment. As shown, the drumstick 52 includes a tip 56 and a handle end 54. For installation, a slippery substance such as liquid soap is applied to the handle end 54 of the drumstick 52. Then the handle end 54 of the drumstick 52 is inserted into either the first end 12 or the second end 14 of the grip 10. The grip 10 is maneuvered onto the drumstick 52 by the user until reaching the desired position and length. As the liquid soap dries, the grip 10 will tend to stay firmly in this desired position on the drumstick 52.

Figure 4:
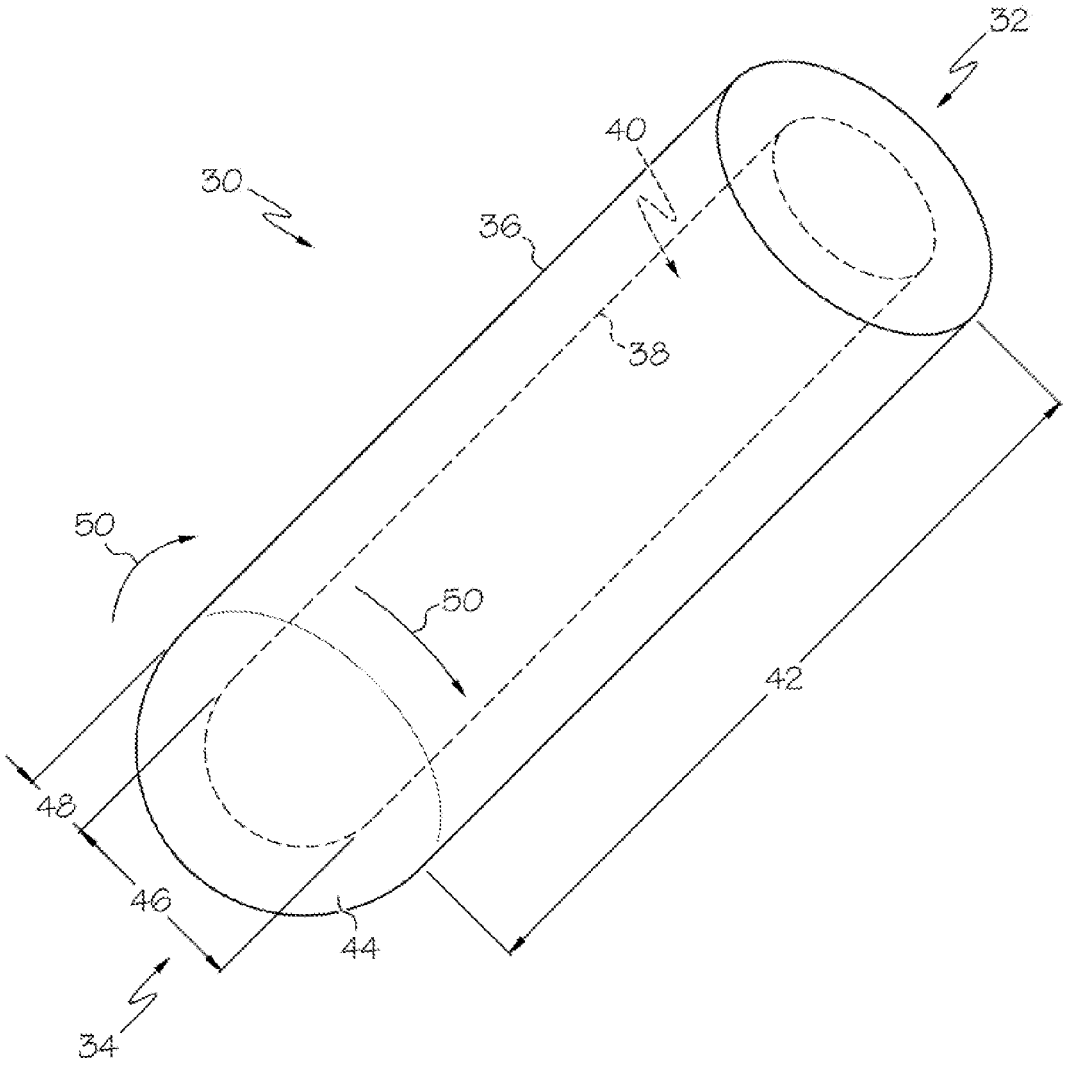
FIG. 4 is a perspective view of an alternative drumstick grip according to a second embodiment.
Figure 5:
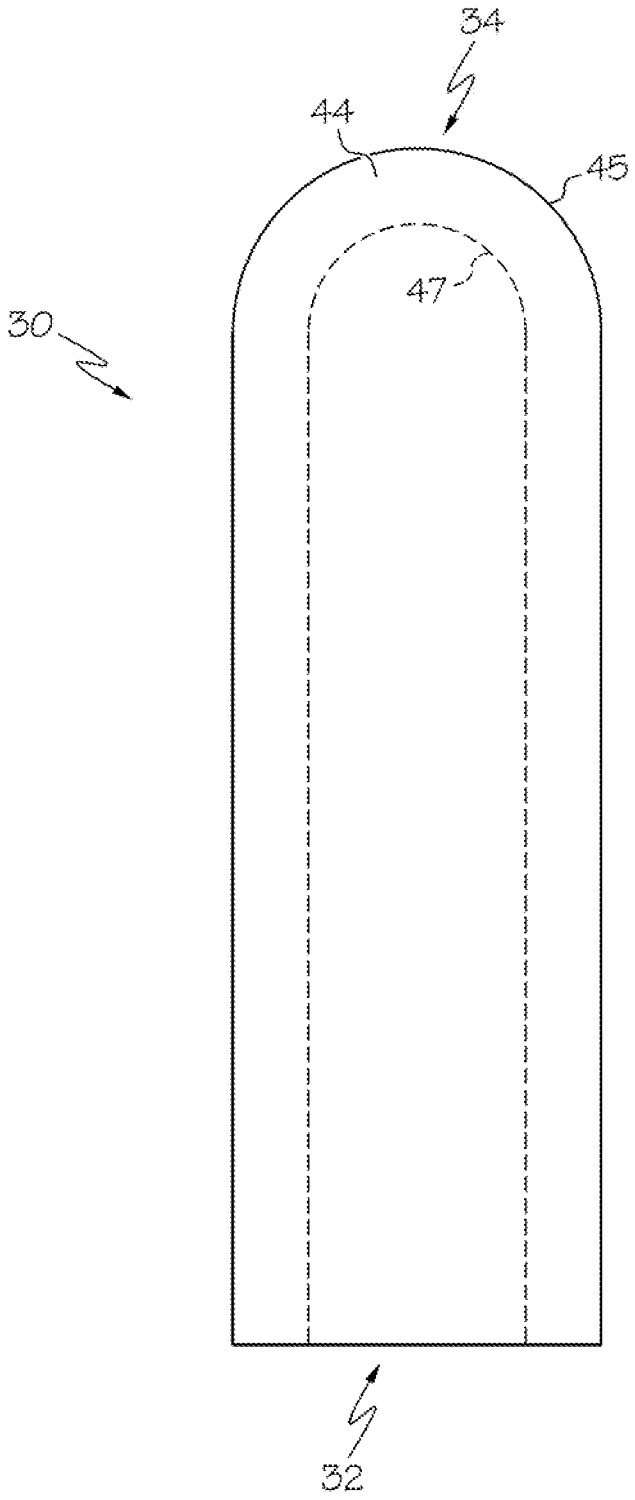
FIG. 5 is a side plan view of the drumstick grip of FIG. 4.

FIGS. 4 and 5 illustrate a drumstick grip 30 in a second embodiment. As illustrated in FIGS. 4 and 5, the grip 30 is generally cylindrical in shape, with a cylindrical internal passageway 40 substantially comprising the longitudinal length of the grip 30. The grip 30 comprises an outer cylindrical wall 36 and an inner cylindrical wall 38. The grip 30 also comprises a first end 32 and a second end 34. The first end 32 of the grip 30 is substantially similar to the first end 12 and the second end 14 of the grip 10 as described above and shown in FIGS. 1-3. In this embodiment, the second end 34 comprises an end cap 44 that is substantially hemispherical in shape along an outer hemispherical wall 45 (as shown in FIG. 5). In various embodiments, the end cap 44 comprises an inner wall 47 that in various embodiments can be, for example, substantially hemispherical, flat or other shape. As shown in FIG. 5, the inner wall 47 of the end cap 44 is substantially hemispherical in shape. In this embodiment, the cylindrical internal passageway 40 is designed to receive a drumstick through the first end 32 of the grip 30.

In one example of the grip 30, a width 46 is the diameter of the cylindrical internal passageway 40 within the inner cylindrical wall 38. A width 48 of the grip 30 is the distance between the outer cylindrical wall 36 and the inner cylindrical wall 38. The grip 30 comprises a longitudinal length 42 is the distance from the first end 32 to the end cap 44 at the second end 34. Furthermore, a circumference 50 is the length of the circumference of the outer cylindrical wall 36 of the grip 30.

In one example of the grip 30, the width 46 of the diameter of the cylindrical internal passageway 40 within the inner cylindrical wall 38 is approximately 0.425 inches, while the width 48 of the grip 30 between the outer cylindrical wall 36 and the inner cylindrical wall 38 is approximately 0.20 to 0.25 inches. Further, in another example, the longitudinal length 42 of the distance from the first end 32 to the end cap 44 at the second end 34 is approximately 5.25 to 6.50 inches. In addition, the circumference 50 of the outer cylindrical wall 36 of the grip 30 is approximately 2⅞ to 3 inches. The above dimensions are examples, and it is recognized that these dimensions can be modified depending upon such factors as hand sizing and personal preference of a user.

In one embodiment, the grip 30 is formed from a closed-cell polyurethane foam material. In an embodiment, this closed-cell polyurethane foam material comprises nitrile rubber. This type of material allows the grip 10 to provide non-slip gripping qualities for the drummer. In addition, the material is washable, and easy to install.

Figure 6:
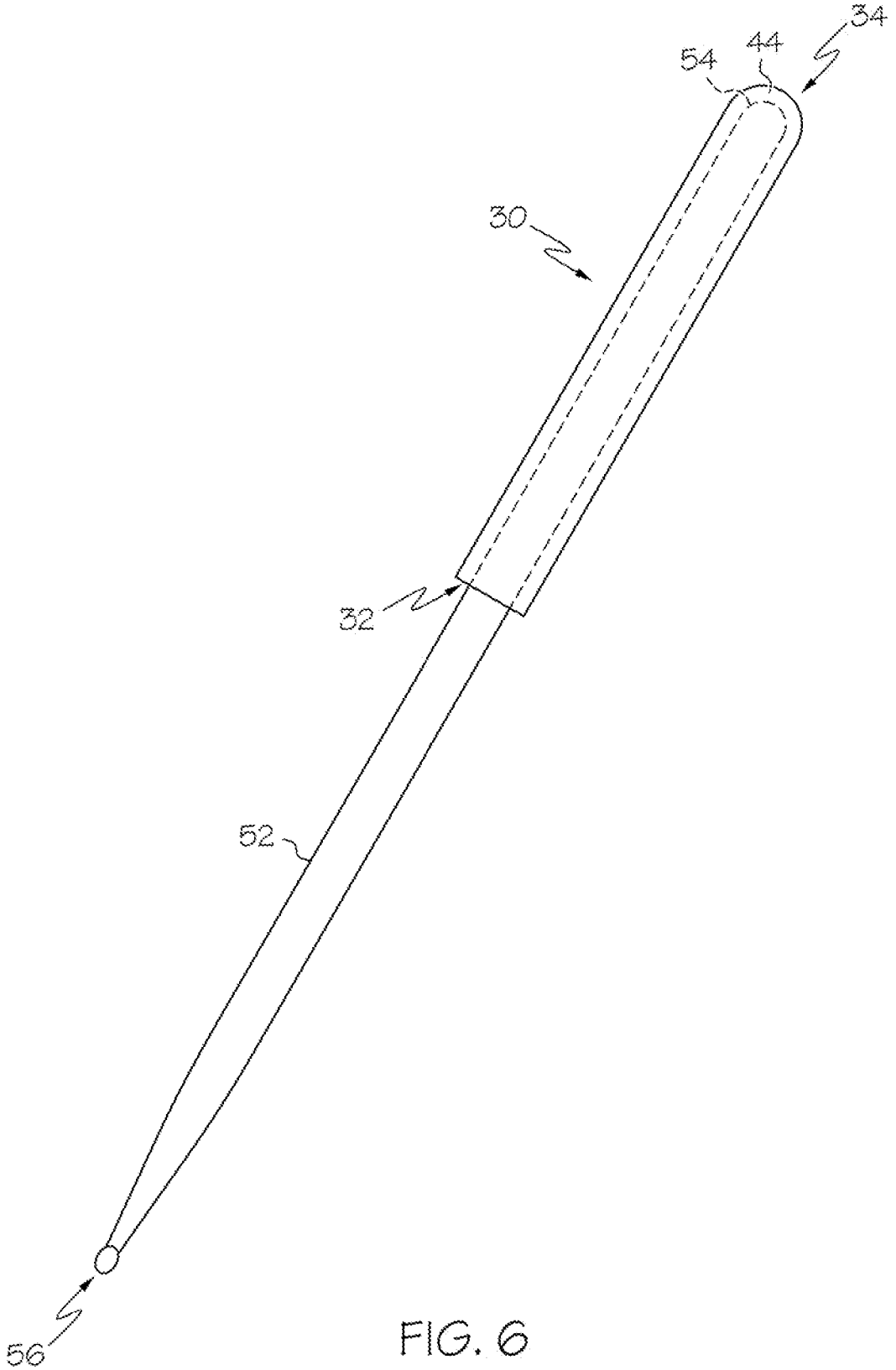
FIG. 6 is a side plan view of the drumstick grip of FIG. 4 attached to a standard drumstick.

FIG. 6 illustrates the grip 30 of FIGS. 4 and 5 as installed on a standard drumstick 52. As shown, the drumstick 52 includes a tip 56 and a handle end 54. For installation, a slippery substance such as liquid soap is applied to the handle end 54 of the drumstick 52. Then the handle end 54 of the drumstick 52 is inserted into the first end 32 of the grip 30. The grip 30 is maneuvered onto the drumstick 52 by the user until reaching the desired position and length and the handle end 54 is substantially adjacent the end cap 44 of the grip 30. As the liquid soap dries, the grip 30 will tend to stay firmly in this desired position on the drumstick 52.

The invention claimed is:

1. A grip for a drumstick, comprising:

a substantially cylindrical sleeve that slips onto a drumstick comprising a tip end and a handle end;

wherein the sleeve comprises a proximal end and a distal end on opposite ends of the sleeve;

wherein the proximal end of the sleeve comprises an opening and the distal end of the sleeve comprises an end cap;

wherein the end cap comprises an inner wall and an outer wall that are substantially hemispherical in shape;

wherein the sleeve comprises a flexible, nitrile rubber foam material; and wherein the proximal end of the sleeve is designed to slip onto a handle end of the drumstick until the end cap is disposed at the handle end of the drumstick.

2. The grip in accordance with claim 1, wherein the sleeve comprises an inner cylindrical wall and an outer cylindrical wall, wherein the distance between the inner cylindrical wall and the outer cylindrical wall is approximately 0.20 inches to 0.25 inches.

3. The grip in accordance with claim 1, wherein the longitudinal length of the sleeve is approximately 5.25 inches to 6.5 inches.

4. The grip in accordance with claim 2, wherein the diameter of the inner cylindrical wall is approximately 0.425 inches.

5. The grip in accordance with claim 2, wherein the circumference of the outer cylindrical wall is approximately 0.875 inches to 3.0 inches.

6. The grip in accordance with claim 1, wherein the cap comprises an inner wall and an outer wall that are substantially hemispherical in shape.

* * * * *